US009950365B2

(12) United States Patent
Steiner et al.

(10) Patent No.: US 9,950,365 B2
(45) Date of Patent: Apr. 24, 2018

(54) DEVICE FOR FASTENING A PERFORATED BLOCK AND PERFORATED BLOCK

(75) Inventors: Benno Steiner, Nebikon (CH); Harry Amsler, Greppen (CH); Angelo Zingre, Hochdorf (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 952 days.

(21) Appl. No.: 14/114,578

(22) PCT Filed: Apr. 26, 2012

(86) PCT No.: PCT/EP2012/001803
§ 371 (c)(1),
(2), (4) Date: Oct. 30, 2014

(87) PCT Pub. No.: WO2012/152383
PCT Pub. Date: Nov. 15, 2012

(65) Prior Publication Data

US 2017/0165747 A1 Jun. 15, 2017

(30) Foreign Application Priority Data

May 6, 2011 (CH) ..... 0813/11
Feb. 8, 2012 (CH) ..... 0196/12

(51) Int. Cl.
*B22D 41/34* (2006.01)
*B22D 41/08* (2006.01)
*B22D 41/56* (2006.01)
*B22D 41/50* (2006.01)

(52) U.S. Cl.
CPC ..... *B22D 41/34* (2013.01); *B22D 41/08* (2013.01); *B22D 41/50* (2013.01); *B22D 41/56* (2013.01)

(58) Field of Classification Search
CPC ..... B22D 41/34; B22D 41/08; B22D 41/56; B22D 41/50
USPC ..... 266/268, 216, 224, 236; 222/597, 598, 222/600, 591, 606, 607, 603
See application file for complete search history.

(56) References Cited

U.S. PATENT DOCUMENTS 3,679,105 A 7/1972 Ratcliffe
4,802,655 A 2/1989 Bates
5,037,072 A 8/1991 King et al.
(Continued)

FOREIGN PATENT DOCUMENTS

GB 1217401 A 12/1970
WO 2012152383 A1 11/2012

*Primary Examiner* — Scott Kastler
*Assistant Examiner* — Michael Aboagye
(74) *Attorney, Agent, or Firm* — Brian Roffe

(57) ABSTRACT

In a device for fastening a perforated block to a metal melt container, the perforated block can be fastened by at least one clamping wedge which can be inserted transversely with respect to its through opening and which has a clamping jaw coupled thereto, wherein this clamping jaw acts on a clamping surface formed on the circumferential surface of the perforated block. The respective clamping wedge is guided in a carrier plate so as to be displaceable in its longitudinal extent or extension and transversely with respect thereto, while the clamping jaw coupled thereto can be moved in this transverse direction. Consequently, the perforated block can be fastened with precise positioning in the carrier plate in a simple manner.

20 Claims, 6 Drawing Sheets

(56) References Cited

U.S. PATENT DOCUMENTS

| | | | | |
|---|---|---|---|---|
| 5,314,099 | A * | 5/1994 | Butz | B22D 41/58<br>164/337 |
| 6,772,922 | B2 * | 8/2004 | Renard | B22D 41/56<br>164/437 |
| 2006/0049555 | A1 * | 3/2006 | Hanse | B22D 41/56<br>266/238 |

* cited by examiner

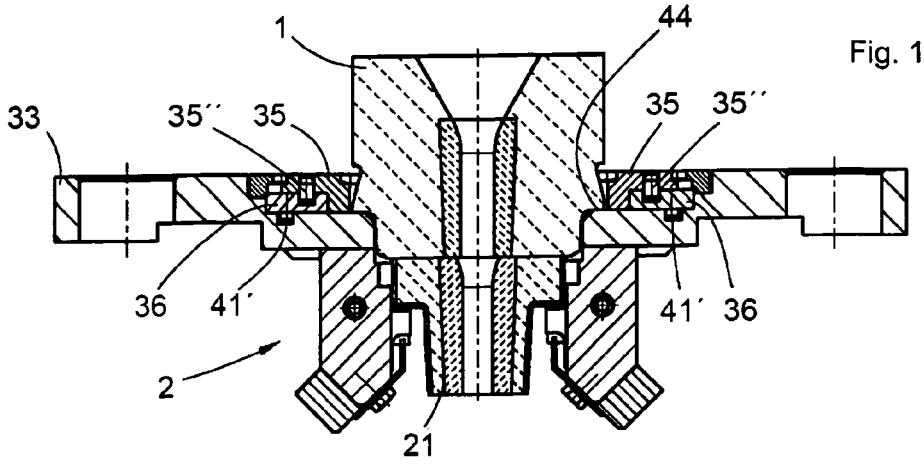
Fig. 11
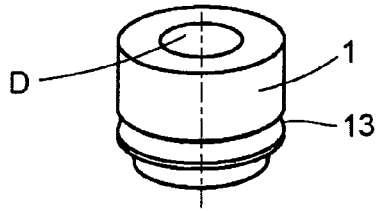
Fig. 12
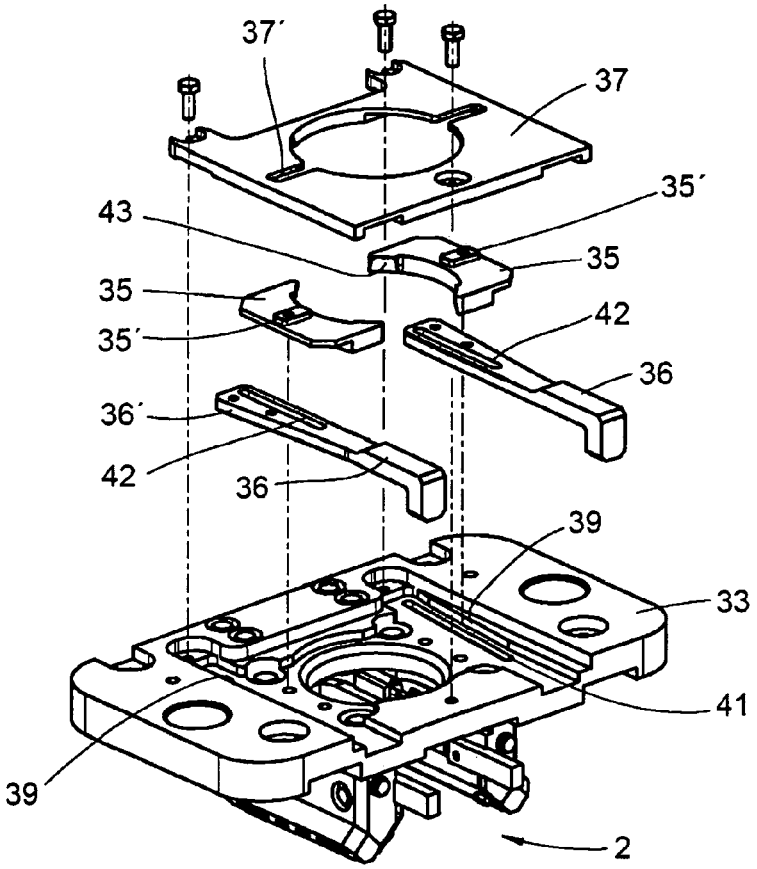

DEVICE FOR FASTENING A PERFORATED BLOCK AND PERFORATED BLOCK

FIELD OF THE INVENTION

The present invention relates to a device for fastening a well block to a vessel containing metal melt which well block forms a spout of the vessel and has a through opening able to be fastened in a housing fixable to the vessel, and to a well block.

BACKGROUND OF THE INVENTION

Well blocks are used in particular in continuous casting lines with vessels for the casting of metal melt, in particular as a fixed spout element with these types of Tundish. These Tundishs generally have a two-part casting channel which on the vessel side comprises a well block provided with a central through opening and on the die side a replaceable nozzle. The well block is embedded securely in the vessel bottom here, in particular is walled into the latter and is generally produced from a fire-proof ceramic material. The nozzle is produced from a heat-resistant fire-proof material and can easily be replaced. The separation point between the well block and the nozzle proves to be particularly critical here because at this separation point, if there is a leak, liquid steel can pass out and ambient air, in particular oxygen, is drawn into the melt flow and so has a negative impact on the quality of the metallic material. Therefore, this separation point should be as leakproof as possible, but is prone to serious cracking during the casting process.

It has therefore also already been proposed to prevent the increased formation of fissures and cracks in the region of the separation point with the aid of a specially configured nozzle. Such nozzles have a stop surface which can be subjected to contact forces in order to press the nozzle against the well block. Unfortunately, these devices prove to be mechanically complex and do not lead to the desired long-term stability.

OBJECTS AND SUMMARY OF THE INVENTION

It is therefore the object of the present invention to provide a device with which a well block for a metal melt vessel can be fastened easily in a housing that can be fixed onto the vessel such as to be stable in the long term.

According to the invention, this object is achieved by a device in which the well block can be fastened by means of at least one clamping wedge insertable transversely to its through opening such that the respective clamping wedge, or a clamping jaw coupled to the clamping wedge, engages against a clamping surface formed on the circumferential surface of the well block and clamps the well block by wedging, and by a well block for use in the device and which includes a base shoulder for resting against a carrier plate of a nozzle exchanger and which well block is provided on the vessel side of the base shoulder with a clamping seat with an adapted cross-section.

With this device according to the invention the formation of cracks in the region of the reference surface between the well block and for example a nozzle can be effectively prevented over the whole casting time.

The well block, which can be fastened in a housing that can be fixed to the metal melt vessel, can be fastened by means of at least one clamping wedge that can be inserted transversely to its through opening, the respective clamping wedge or a clamping jaw coupled to the latter engaging against a clamping surface formed on the circumferential surface of the well block and clamping the well block.

In one particular embodiment of the present invention the housing comprises a nozzle exchanger with a carrier plate and a wedge guide plate, the wedge guide plate being able to be connected securely to the carrier plate. The wedge guide plate has an opening for receiving the well block and at least one guide groove partially overlapping this opening for guiding and supporting a clamping wedge such that the wedge can press flat and permanently onto the well block with its inclined wedging surface.

One particular design of the clamping wedge makes it possible to produce a permanent mechanical tension, i.e. a tension equalising heat and vibrations, between the wedge guide plate and the well block and thus also prevents the formation of cracks in the region of the reference surface during the casting process.

Further embodiments of this device have the features of for example, the at least one clamping wedge being guided in the carrier plate such that it moves along the co-operating wedge surfaces provided on it and on the carrier plate and so executes a quasi-transverse movement with respect to its direction of displacement.

In particular, a well block which is suitable for use in this type of device has a clamping seat co-operating with the wedge surface on the vessel side.

The clamping wedges according to the invention can be inserted, re-tensioned or replaced without any special tool, and this substantially simplifies upkeep.

BRIEF DESCRIPTION OF THE DRAWINGS

In the following exemplary embodiments and further advantages of the invention are described in more detail by means of the figures. These show as follows:

FIG. 11 is a schematic illustration of a longitudinal section through a version of a device according to the invention for clamping a well block to a carrier plate for a nozzle exchanger; and FIG. 12 is a schematic exploded illustration of the well block and of the device according to FIG. 11.

DETAILED DESCRIPTION OF THE INVENTION

Figure 1:
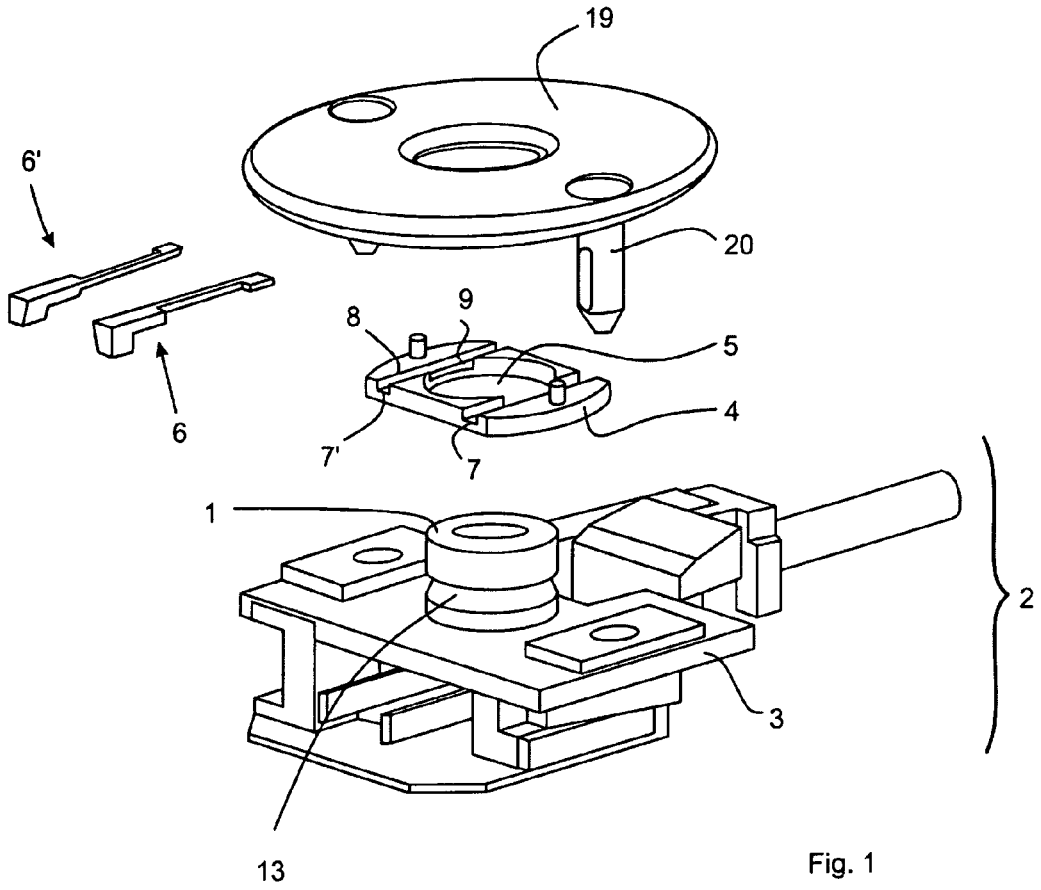
FIG. 1 is a schematic exploded illustration of a device according to the invention for clamping a well block onto a carrier plate for a nozzle exchanger.

FIG. 1 shows an exploded illustration of a device according to the invention for fastening a well block 1 onto a vessel for metal melt. In the device a base plate 19 is embedded in the bottom of this vessel. This base plate 19 has two wedge pins 20 onto which a carrier plate 3 can be fastened. This carrier plate 3 forms on the one hand a base for a nozzle exchanger 2 and is on the other hand a carrier for the well block 1 which lies flat with its base shoulder 14.

According to the invention, a wedge guide plate 4 is provided between this carrier plate 3 and the base plate 19. This wedge guide plate 4 has a circular opening 5 through which the well block 1 passes in the fitted state. For this purpose, the well block 1 is provided with a sloped clamping surface 13. Moreover, this wedge guide plate 4 has at least one guide groove 7 into which a clamping wedge 6 can be inserted. This clamping wedge 6 is supported by its support parts 11, 11' lying flat against a support surface 8 of this guide groove 7. The guide groove 7 is arranged such that it is overlapped by the circular opening 5 and a cut-out 9 is formed opposite the support surface 8 in the guide groove 7. Preferably, the wedge guide plate 4 is formed by two guide grooves 7, 7' running parallel and into which clamping wedges 6, 6' can be introduced. In the fitted state, these clamping wedges 6, 6' lie with their wedging surface 12 with force fit against the clamping surface 13 of the well block 1.

Figure 2:
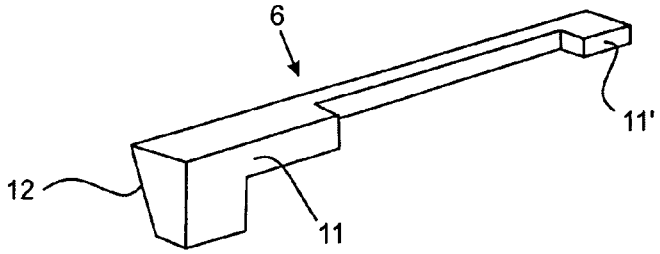
FIG. 2 is a perspective illustration of a clamping wedge according to the invention.

A preferred embodiment of the clamping wedge 6 according to the invention is shown in FIG. 2. This clamping wedge 6 has support parts 11, 11' which are supported against the support surface 8 of the guide groove 7. The wedging surface 12 facing towards the well block 1 has the same incline as the clamping surface 13 of the well block 1. A recess between the two support parts 11, 11' enables flexible clamping of this clamping wedge 6.

Figure 3:
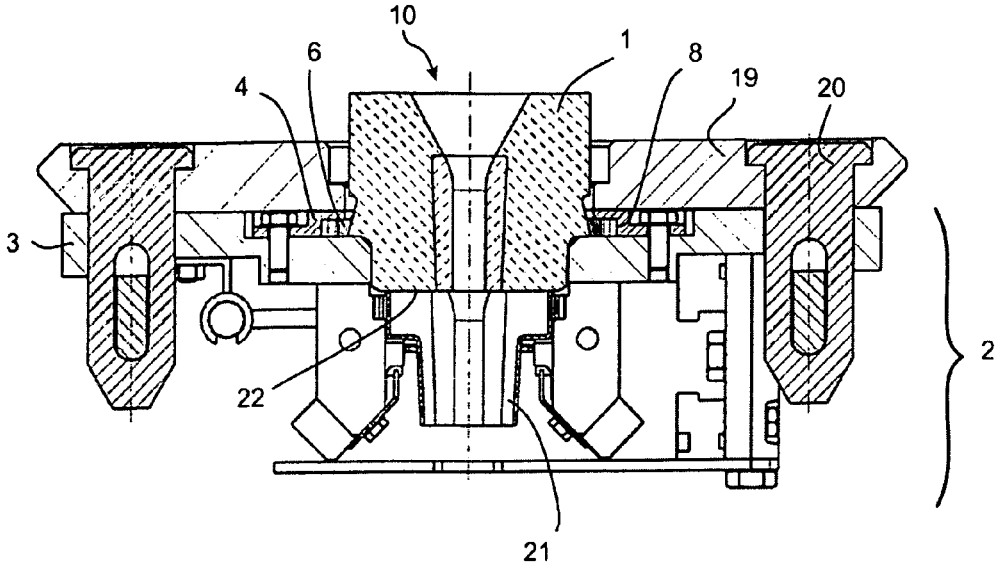
FIG. 3 is a schematic illustration of a longitudinal section through a device according to the invention for clamping a well block onto a carrier plate for a nozzle exchanger.

The device illustrated in cross-section in FIG. 3 has a wedge guide plate 4 which is fixed to the carrier plate 3. This makes it possible to fasten the well block 1 before fitting. Here the well block 1 is guided through the opening 5 of the wedge guide plate 4 and is placed on the carrier plate 3 with its circumferential base shoulder 14. With the insertion of the clamping wedges 6, 6' the well block 1 and the nozzle 21 are clamped such that the abutting surfaces 22 are pressed together under tension. In a last fitting step the carrier plate 3 is fastened to the base plate 19 with the aid of the wedge pins 20.

Figure 4:
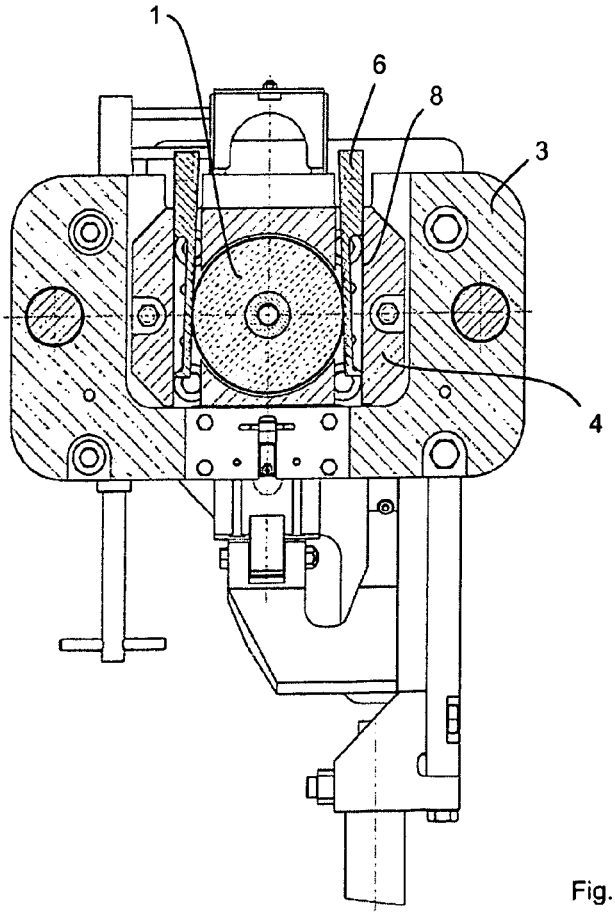
FIG. 4 is a schematic illustration of a cross-section through a device according to the invention for clamping a well block onto a carrier plate for a nozzle exchanger.
Figure 5:
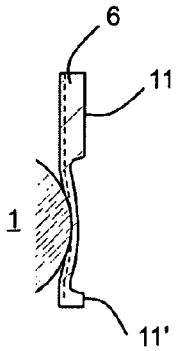
FIG. 5 is a schematic illustration showing the mode of operation of the clamping wedge according to the invention.

FIG. 4 illustrates the configuration of the wedge guide plate 4 and the mode of operation of the device according to the invention. In the fitted state the clamping wedges 6, 6' are supported with their support parts 11, 11' against the support surface 8 of the respective guide grooves 7. In a region between the two support parts 11, 11' these clamping wedges 6, 6' press onto the clamping surface 13 of the well block 1 as can be seen in FIG. 5.

Figure 6:
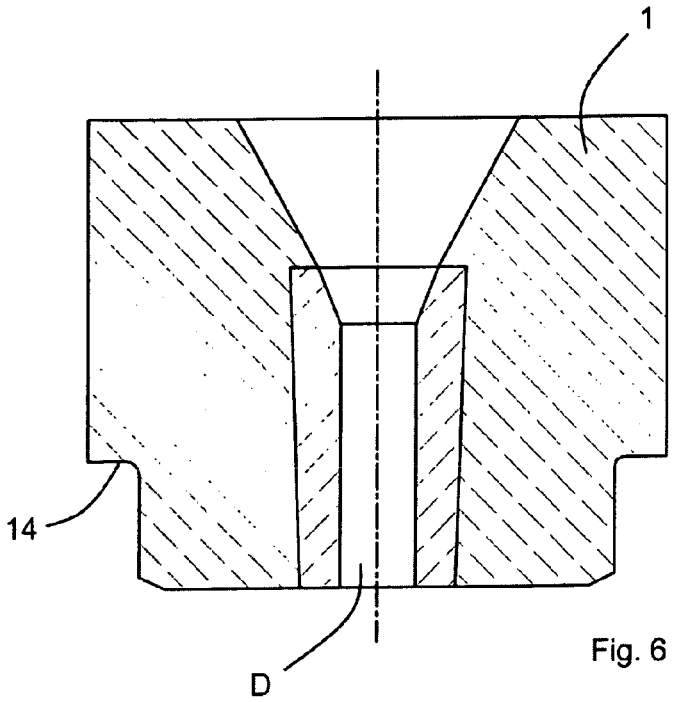
FIG. 6 is a schematic illustration of a longitudinal section through a well block of a known type.
Figure 7:
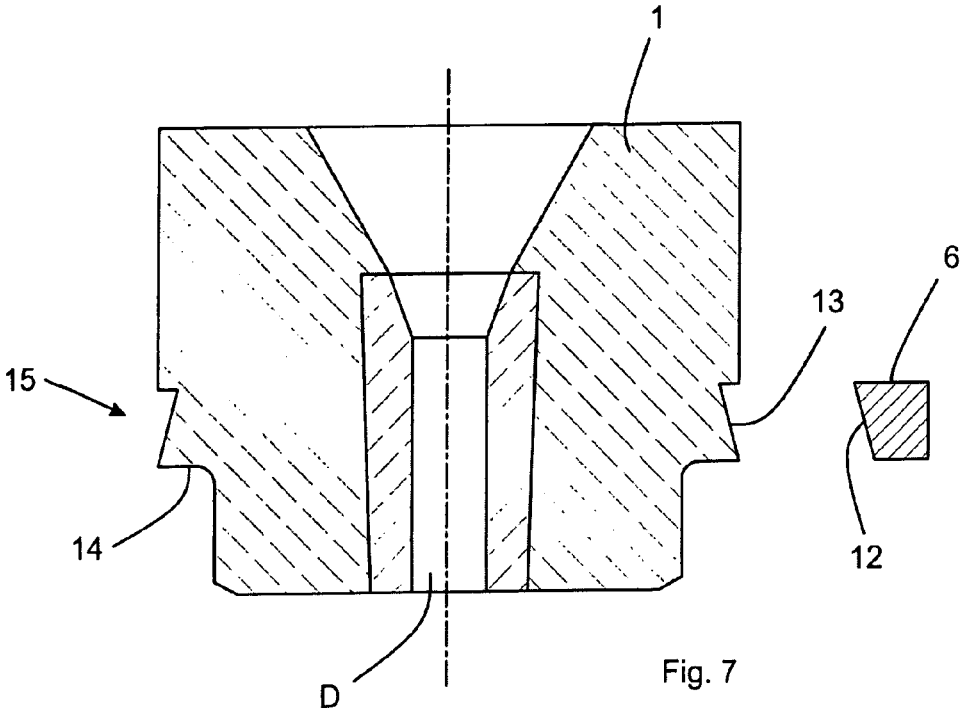
FIG. 7 is a schematic illustration of a longitudinal section through a well block according to the invention with a saw tooth-shaped groove.

FIG. 6 shows a well block 1 of a known type comprising a base shoulder 14 and a through opening D. In a first embodiment according to the invention, as shown in FIG. 7, the well block 1 has on the vessel side of the base shoulder 14 a clamping seat 15 with a saw tooth-shaped cross-section. The clamping surface 13 of this clamping seat 15 co-operates with the wedge surface 12 of the clamping wedges 6, 6'.

Figure 8:
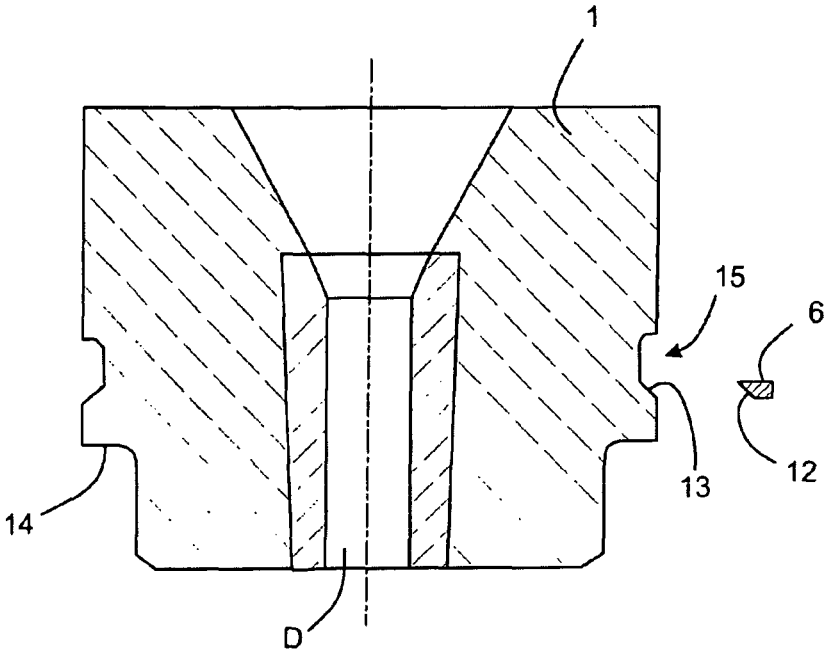
FIG. 8 is a schematic illustration of a longitudinal section through a well block according to the invention with a trapezoidal groove.

FIG. 8 shows a further embodiment of the well block 1 according to the invention with an annular clamping seat 15 which has a substantially trapezoidal cross-section. This clamping seat 15 could also be curved in form as considered in section.

Figure 9:
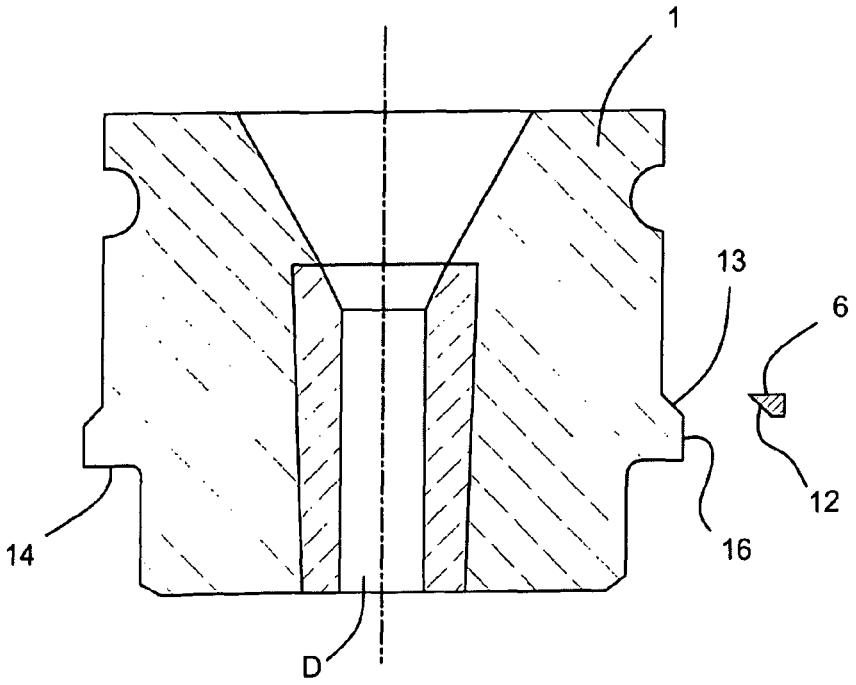
FIG. 9 is a schematic illustration of a longitudinal section through a well block according to the invention with a trapezoidal protrusion.

It goes without saying that the well block 1 can be provided, instead of with a clamping seat 15, with a clamping lug 16 which, as can be seen from FIG. 9, has an inclined clamping surface 13.

Figure 10:
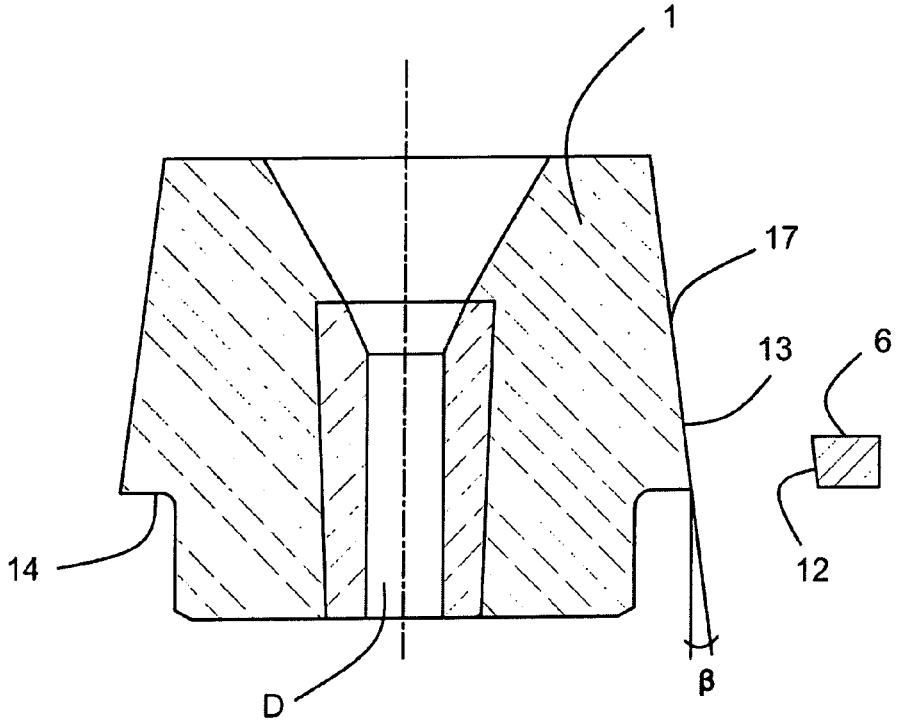
FIG. 10 is a schematic illustration of a longitudinal section through a well block according to the invention with a conical flank.

In a further configuration of the well block 1, as shown in FIG. 10, there is provided on the vessel side of the base shoulder 14 neither a specially formed clamping seat 15 nor a specially formed clamping lug 16, but rather this well block 1 is conical in shape such that its cone flank 17 forms a flank angle 13 which corresponds to the incline of the wedge surface 12 of the clamping wedge 6.

FIG. 11 and FIG. 12 show a version of a device for fastening a well block 1 to a vessel containing metal melt, the differences in comparison to the device according to FIG. 1 to FIG. 4 now being described below.

The well block 1 is fastened by means of clamping wedges 36 displaceable transversely to its through opening D such that a clamping jaw 35 coupled to the respective clamping wedge engages against a clamping surface 13 formed on the circumferential surface of the well block 1. The respective clamping wedge 36 is guided here in the carrier plate 33 in its longitudinal extension and transversely to the latter, and the clamping jaw 35 coupled to the latter is guided displaceable quasi transversely thereto. The clamping wedge 36 moves here along the co-operating wedge surfaces 36', 39 provided on it and on the carrier plate 33, a cam 41' moreover being assigned to it which engages in a longitudinal groove 41 in the carrier plate 33 running parallel to the wedge surface 39.

The clamping jaws 35 on their part are guided by means of guide cams 35' in a respective groove 37' of a covering plate 37 that can be fastened to the carrier plate 33 almost radially to the circular well block circumference. Moreover, the clamping jaws 35 respectively have a downwardly projecting bolt 35" which is guided in an elongate groove 42 in the clamping wedge 36, this groove 42 running tangentially to the circular well block circumference and not parallel to the corresponding wedge surface 39, so that when displacing the clamping wedge 36 this desired transverse movement of the clamping jaw 35 takes place.

The clamping of a well block takes place in such a way that when the clamping wedges 36 are drawn away from the well block 1, the clamping jaws 35 on their part are displaced towards the well block 1 and clamp the latter on both sides on its annular clamping surface 13. Advantageously, two rounded clamping surfaces 43 are respectively provided on the clamping jaws 35 for optimal clamping. By means of this clamping force acting downwardly at an angle, the well block 1 is pressed with its base shoulder 14 against a reference surface 44 at the opening in the carrier plate 33 so that the well block is always positioned at the same height in relation to the nozzle exchanger.

When the clamping jaws 35 are released from the well block 1, the clamping wedges 36 are pushed or pressed against the well block, and this enables easy handling.

The invention is sufficiently demonstrated by the exemplary embodiments described above. It could, however, also be illustrated by further variations. It thus goes without saying that the clamping surface 13 can for example be in the form of a circumferential annular surface or of a polygon surface.

A fire-proof sleeve can also generally be used as a well block, and a conventional slide closure or the like could also be provided instead of a nozzle exchanger.

It is also conceivable as a variation for just one clamping wedge to be able to be provided with or without a clamping jaw, a fixed stop or the like then being provided on the opposite side of the well block 1.

The invention claimed is:

1. A device for fastening a well block to a vessel containing metal melt, the well block forming a vessel spout and having a through opening and a clamping surface, the device comprising:

at least one movable clamping wedge having a longitudinal extension;

a carrier plate that guides movement of said at least movable clamping wedge relative to said carrier plate in a longitudinal direction and also in a direction transverse to the longitudinal direction during movement of said at least one clamping wedge in the longitudinal direction; and a clamping jaw coupled to each of said at least one clamping wedge and being movable transverse to the longitudinal direction, whereby when the well block is engaged with said carrier plate, said at least one clamping jaw coupled to each of said at least one clamping wedge is engageable with the clamping surface of the well block to clamp the well block by wedging.

2. The device according to claim 1, wherein the longitudinal direction in which said at least one clamping wedge is movable relative to said carrier plate is a direction transverse to the through opening of the well block when the well block is engaged with said carrier plate.

3. The device according to claim 1, wherein said carrier plate includes a first set of wedge surfaces and said at least one clamping wedge includes a second set of wedge surfaces that contact said first set of wedge surfaces to enable movement of said at least one clamping wedge in the direction transverse to the longitudinal direction during movement said at least one clamping wedge in the longitudinal direction.

4. The device according to claim 3, wherein each of said at least one clamping wedge includes a cam and said carrier plate includes a respective groove, said cam of each of said at least one clamping wedge engaging with said respective groove to guide movement of said at least one clamping wedge relative to said carrier plate.

5. The device according to claim 4, wherein said respective groove is parallel to one of said wedge surfaces of said first set of wedge surfaces.

6. The device according to claim 1, wherein said at least one clamping wedge comprises two clamping wedges arranged parallel to one another such that the device includes two clamping jaws, one coupled to each of said two clamping wedges.

7. The device according to claim 6, wherein said clamping jaws are movable in one direction toward one another to clamp the well block when engaged with said carrier plate and movable in an opposite direction away from one another to enable release of the well block from clamping.

8. The device according to claim 6, wherein said carrier plate includes first and second wedge surfaces and said at least one clamping wedge includes first and second wedge surfaces that contact said first and second wedge surfaces, respectively, of said carrier plate to enable movement of said two clamping wedges in the direction transverse to the longitudinal direction during movement of said two clamping wedges in the longitudinal direction.

9. The device according to claim 1, wherein said clamping jaw includes a guide cam, further comprising a covering plate fastened to said carrier plate and including a respective groove with which said guide cam of a respective clamping jaw engages to guide movement of said clamping jaw relative to said carrier plate.

10. The device according to claim 9, wherein said clamping jaw further includes a bolt and said at least one clamping wedge includes an elongate groove with which said bolt of said at least one clamping wedge engages to guide movement of said clamping jaw relative to said clamping wedge.

11. The device according to claim 1, wherein said clamping jaw includes a bolt and said at least one clamping wedge includes an elongate groove with which said bolt of said at least one clamping wedge engages to guide movement of said clamping jaw relative to said clamping wedge.

12. The device according to claim 11, wherein said carrier plate includes a first set of wedge surfaces and said at least one clamping wedge includes a second set of wedge surfaces that contact said first set of wedge surfaces to enable movement of said at least one clamping wedge in the direction transverse to the longitudinal direction during movement of said at least one clamping wedge in the longitudinal direction, and said elongate groove in said at least one clamping wedge is not parallel to a corresponding one of said wedge surfaces of said first set of wedge surfaces such that when displacing said at least one clamping wedge, transverse movement of said clamping jaw coupled to said at least one clamping jaw occurs.

13. The device according to claim 1, wherein said at least one clamping wedge and said clamping jaw coupled to said at least one clamping wedge are configured such that movement of said at least one clamping wedge longitudinally in a direction outward from said carrier plate causes said clamping jaw to move inward and clamp the well block when engaged with said carrier plate.

14. The device according to claim 1, wherein said carrier plate includes an opening and said at least one clamping wedge is arranged to move in the longitudinal direction alongside said opening such that the transverse direction is a direction toward said opening.

15. The device according to claim 1, wherein said clamping jaw includes a rounded clamping surface.

16. A device for fastening a well block to a vessel containing metal melt, the well block forming a vessel spout and having a through opening and a clamping surface, the device comprising:

a housing including a base plate and a carrier plate;

a wedge guide plate arranged between said base plate and said carrier plate, said wedge guide plate being secured to said carrier plate and including an opening into which the well block is received when engaging with said housing and at least one guide groove overlapping said opening; and at least one clamping wedge each guided and supported in a respective one of said at least one guide groove, whereby when the well block is engaged with said housing, said at least one clamping wedge is engageable with the clamping surface of the well block to clamp the well block by wedging.

17. The device according to claim 16, wherein said at least one guide groove includes a support surface for supporting a respective one of said at least one clamping wedge and a recess opposite said support surface for clamping the well block when engaged with said housing.

18. The device according to claim 16, wherein said at least one guide groove includes two support surfaces and a recess opposite said support surface for clamping the well block when engaged with said housing, said at least one clamping wedge including two support parts spaced apart from one another and which are configured to brace against said two support surfaces.

19. The device according to claim 16, wherein said at least one clamping wedge has an inclined or rounded wedge surface shaped such that when the well block is engaged with said housing, said wedge surface presses against the clamping surface of the well block.

20. The device according to claim 16, wherein said housing defined by said carrier plate and said base plate is for a nozzle exchanger.

* * * * *